US006712246B2

(12) United States Patent
Nobbio

(10) Patent No.: US 6,712,246 B2
(45) Date of Patent: Mar. 30, 2004

(54) PHIAL FOR DISTRIBUTING PRODUCTS, WITH AN IMPROVED APPLICABILITY

(75) Inventor: Alessio Nobbio, Milan (IT)

(73) Assignee: Inge S.p.A., Garbagnate Milanese (IT)

( * ) Notice: Subject to any disclaimer, the term of this patent is extended or adjusted under 35 U.S.C. 154(b) by 0 days.

(21) Appl. No.: 10/095,635

(22) Filed: Mar. 11, 2002

(65) Prior Publication Data

US 2002/0130145 A1 Sep. 19, 2002

(30) Foreign Application Priority Data

Mar. 13, 2001 (IT) ..... MI2001A0533

(51) Int. Cl.[7] ..... B67D 3/00

(52) U.S. Cl. ..... 222/527; 222/529; 604/39; 604/257; 604/187

(58) Field of Search ..... 222/527, 529; 604/38, 247, 262, 257, 408, 905, 181, 187

(56) References Cited

U.S. PATENT DOCUMENTS

| | | | | | |
|---|---|---|---|---|---|
| 3,093,273 | A | * | 6/1963 | Borah | 222/527 |
| 3,323,694 | A | | 6/1967 | Stevens | |
| 3,628,705 | A | * | 12/1971 | Rieke | 222/517 |
| 3,986,646 | A | * | 10/1976 | Strub | 222/529 |
| 4,168,032 | A | * | 9/1979 | Sneider | 239/327 |
| 4,274,555 | A | * | 6/1981 | Sneider | 222/107 |
| 4,336,801 | A | * | 6/1982 | Sentell et al. | 604/31 |
| 4,405,306 | A | * | 9/1983 | Pritchard et al. | 604/87 |
| 4,572,412 | A | | 2/1986 | Brach et al. | |
| 4,776,848 | A | * | 10/1988 | Solazzo | 604/247 |
| 4,964,852 | A | * | 10/1990 | Dunning et al. | 604/75 |
| 5,065,913 | A | * | 11/1991 | Glasener | 222/528 |
| 5,088,632 | A | * | 2/1992 | Odet et al. | 222/529 |
| 5,125,914 | A | * | 6/1992 | Bassin | 604/275 |
| 5,219,337 | A | * | 6/1993 | Takata et al. | 604/185 |
| 5,380,275 | A | * | 1/1995 | Kensey et al. | 604/27 |
| 5,503,308 | A | | 4/1996 | Young et al. | |
| 5,577,643 | A | * | 11/1996 | Stolz | 222/529 |
| 6,293,927 | B1 | * | 9/2001 | McGuckin, Jr. | 604/279 |

FOREIGN PATENT DOCUMENTS

| | | |
|---|---|---|
| DE | 34 09 867 | 9/1985 |
| WO | WO 97 08096 | 3/1997 |

OTHER PUBLICATIONS

EP Search Report.

* cited by examiner

*Primary Examiner*—Gene Mancene
*Assistant Examiner*—Frederick C Nicolas
(74) *Attorney, Agent, or Firm*—Hedman & Costigan, P.C.

(57) ABSTRACT

A phial (10) for distributing products, in particular medicinal products, lubricants, glues and creams, comprising a truncated-conical annular wall (18), positioned between the walls of the mouthpiece (14) and those of the collar (15) of the above phial (10), in order to allow a stable positioning of a distributing element, which extends from the mouthpiece (14), also in inclined positions with respect to the vertical axis (19) of the phial (10); this allows a simplified application of the product, also in points which are extremely difficult to reach and in sensitive and delicate areas of the human body.

8 Claims, 4 Drawing Sheets

PHIAL FOR DISTRIBUTING PRODUCTS, WITH AN IMPROVED APPLICABILITY

The present invention relates to a phial for distributing products, with an improved applicability. Phials for distributing products, such as lubricants, glues, shoe-creams and, in particular, medicinal products, such as, for example, anti-hemorrhoidal ointments and/or solutions for vaginal irrigations, currently comprise a distributing element (cannula, sponge or spout), which can be normally orientated, in order to facilitate application, above all when the user applies the product on himself. This possibility of orientation is obtained thanks to the possible inclusion, in correspondence with the top of the phial, of a bellows portion situated, in particular, between the body of the phial and distribution mouthpiece; this solution, however, does not allow the distributing element to stably adopt any inclined position, with respect to the longitudinal axis, once orientated, and the user must therefore maintain this position manually.

This is particularly uncomfortable and harmful, as the force exerted by the user to keep the bellows folded can cause an undesirable pressure on the distributing element which, when pressed on the user's body, can make application difficult; furthermore, when the distributor is used for anti-hemorrhoidal applications or vaginal irrigations, this problem is even more serious as the parts with which the distributor comes into contact are particularly sensitive and delicate.

Alternatively, distributor phials are used, in which the distributing element can be orientated and can take on stable inclined positions, with respect to the vertical axis; these phials comprise the use of a sphere, which rotates inside a suitably-shaped housing, to which the base of a distributing cannula is attached, allowing the cannula to rotate freely in the various positions and maintain the position reached, without having to resort to a manual intervention on the part of the user.

The use of a sphere joint, however, for maintaining an inclined position of the distributing element also has various disadvantages, of which the first drawback relates to the high production and assembly costs.

Furthermore, as the production of this type of phial comprises the assembly of a certain number of elements, it is extremely complicated to guarantee the hermetic sealing of the phial in correspondence with the joint, due to the traditional work tolerances; in this respect, it is therefore necessary to use a further external containment element to protect from any possible product deformation, which obviously influences the total production costs.

An objective of the present invention is consequently to overcome the disadvantages mentioned above and, in particular, to produce a phial for distributing products, which simplifies the application operations of the product for the user, at the same time guaranteeing extremely limited overall production costs, with respect to the known art.

Another objective of the invention is to indicate a phial for distributing products, in particular lubricants, creams, glues or medicinal products, which maintains an excellent seal, without external deformation of the product.

A further objective of the present invention is to produce a phial for distributing medicinal products, in particular for the application of anti-hemorrhoidal ointments or for vaginal irrigations.

These and other objectives, according to the present invention, are achieved by the production of a phial for distributing products, with an improved applicability, according to claim 1.

According to the invention, it is advantageously possible to considerably simplify the application of medical or other products, making their use particularly safe and further reducing the overall production costs.

Other characteristics and advantages of a phial for distributing products with an improved applicability, according to the present invention, can be more clearly understood from the following illustrative and non-limiting description, referring to the enclosed schematic drawings, wherein.

Figure 1:
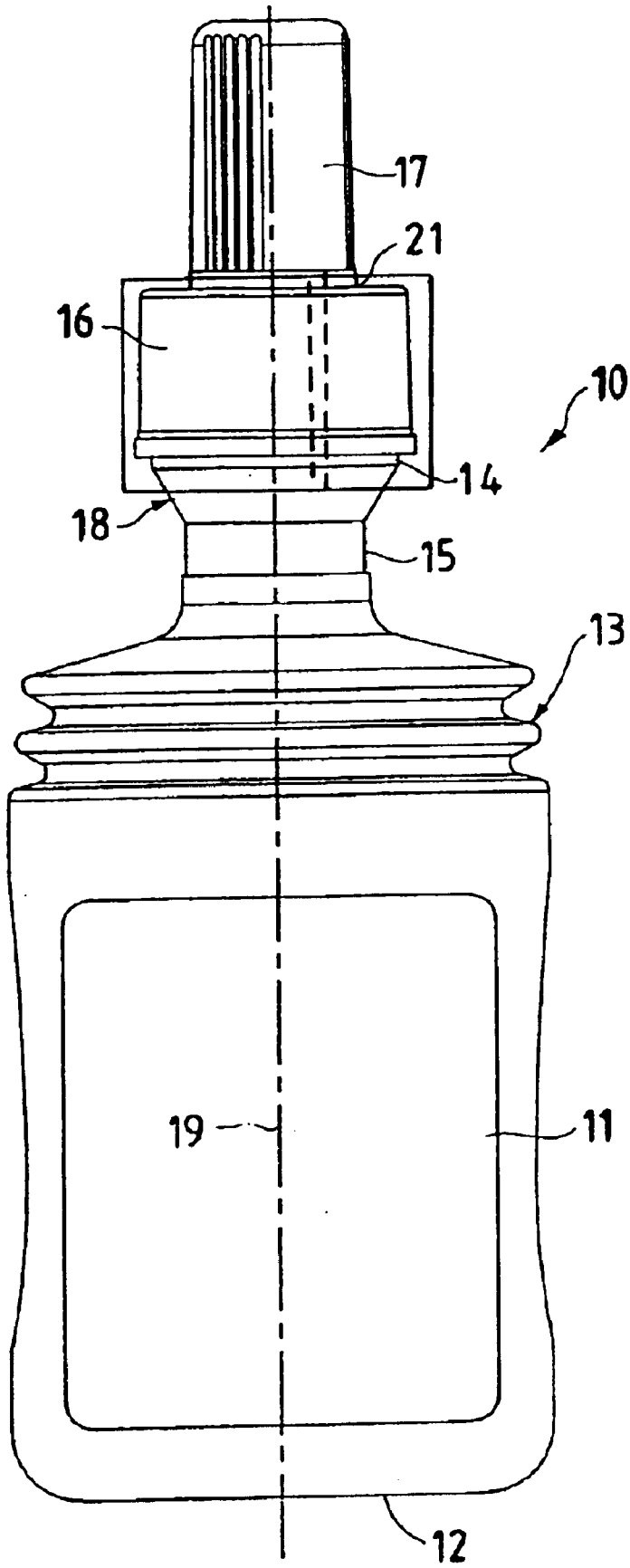
FIG. 1 is a front view of a phial for distributing products with an improved applicability, according to the present invention.

With reference to the above figures, 10 generically indicates a phial for distributing products, according to the present invention, comprising a container body 11 of the product to be distributed, a base 12, a bellows portion 13, a mouthpiece 14, a collar 15, a diameter reducing element 16 and a covering and protective cap 17 of a distributing element.

It should be explained once and for all that, depending on the specific applications, the phial 10 can have different configurations and geometrical forms and can comprise various distributing elements, as it may also include different sealing devices between the distributing element and the mouthpiece 14.

In particular, in illustrative and preferred but non-limiting embodiments of the invention, the bellows portion 13 may also be omitted and the body 11 of the phial 10 can be round-shaped and without edges, to allow easier handling during application.

Furthermore, the hermetic seal between the distributing element and mouthpiece 14 may also be obtained by means of a capsule having a U-shaped section and comprising a circular portion with a pre-established fracture, to allow access to the base 12.

Figure 5:
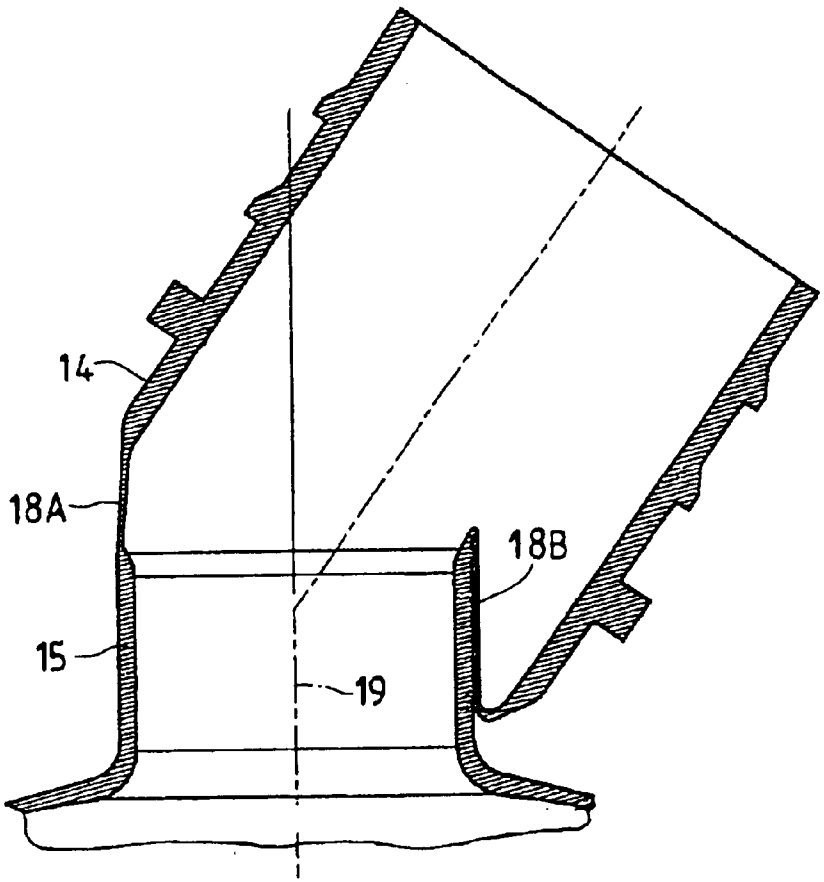
FIG. 5 is a partial, enlarged section of the phial of FIG. 1, in a position according to which the cannula is inclined to allow application of the product, in accordance with the invention.
Figure 4:
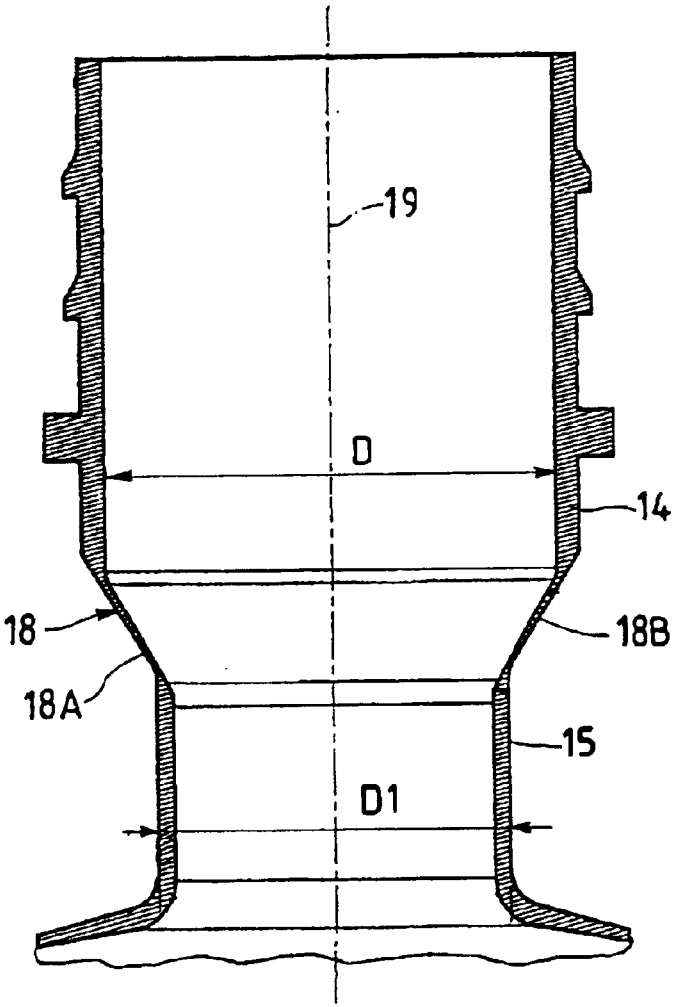
FIG. 4 is a partial, enlarged section of the phial of FIG. 1, in rest position.
Figure 6:
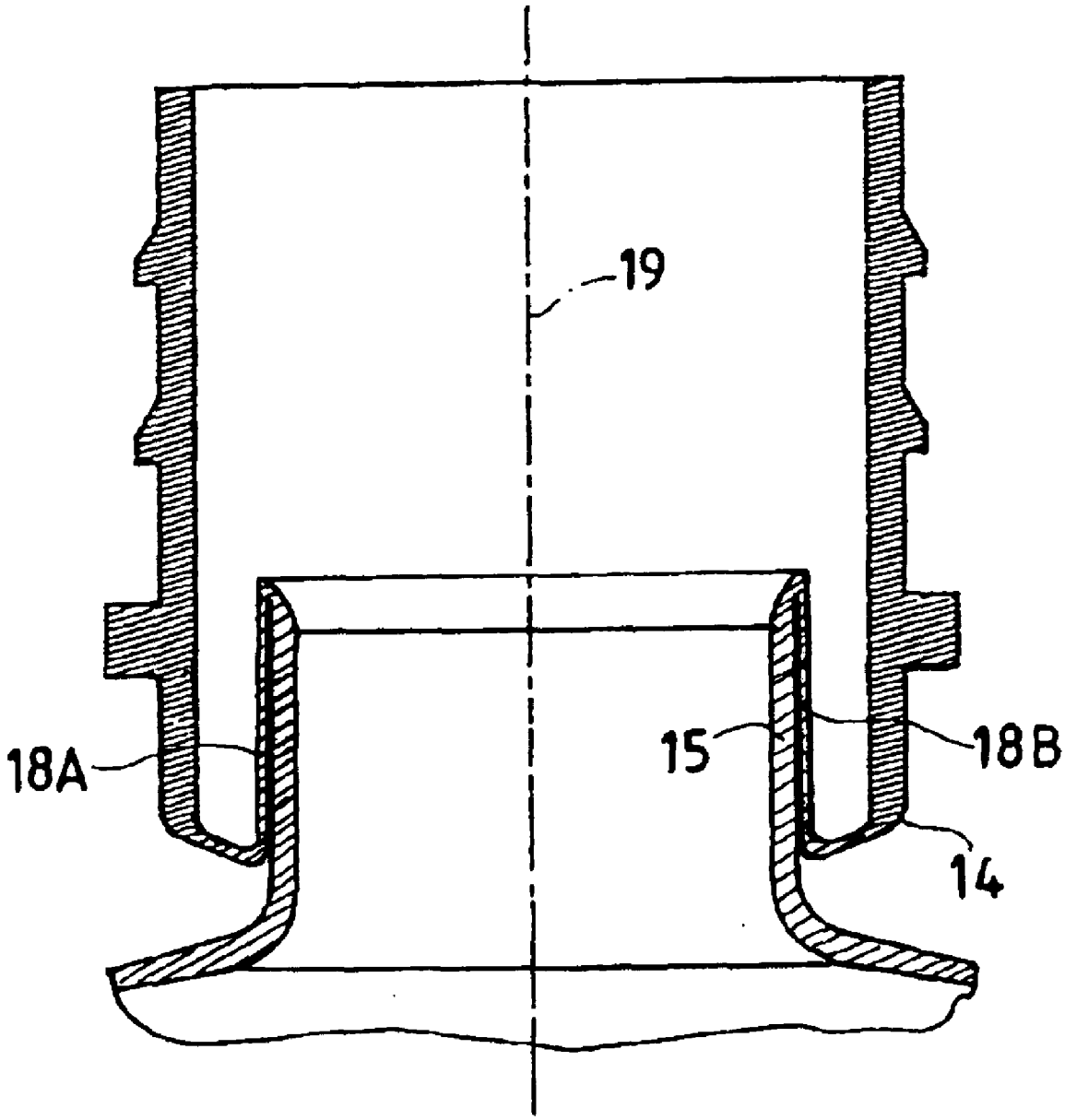
FIG. 6 is a partial, enlarged section of the phial of FIG. 1, in a position according to which the mouthpiece of the phial envelops the collar, in order to allow further applications.

Alternatively, as can be seen, for example, in FIGS. 4–6, the hermetic seal between the distributing element and mouthpiece 14 is obtained by means of the reducing element 16, which frontally rests on the mouthpiece 14 forming a double seal, specifically between the distributor and reducer 16 and between the reducer 16 and mouthpiece 14.

Figure 2:
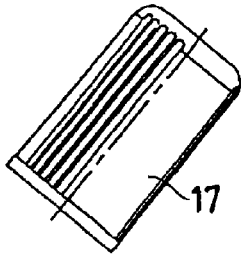
FIG. 2 illustrates a blow-up of a removal phase of a closing cap of the phial according to FIG. 1.
Figure 2:
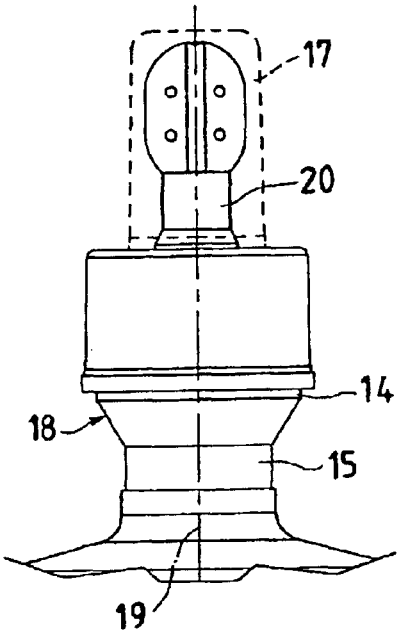
Figure 3:
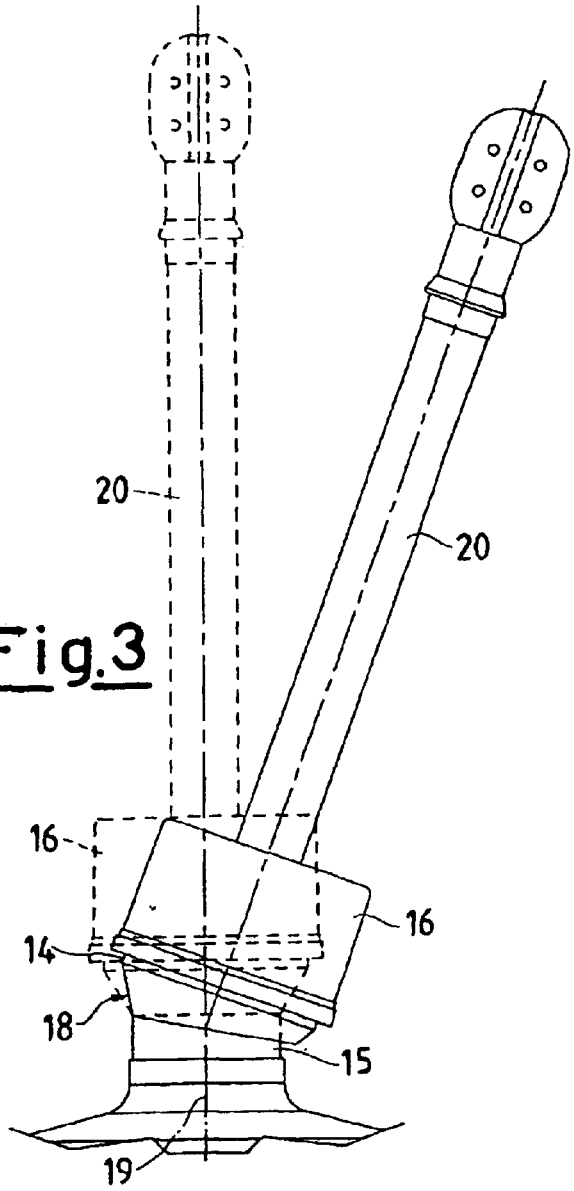
FIG. 3 illustrates an at least partial extraction phase from the phial of the distributing cannula, according to FIG. 2, and subsequent inclination of the above cannula for the application of the product.

Finally, the distributing element may also have different configurations, depending on the use; it may in fact consist, even if not exclusively, of a cannula 20, as in the case represented in FIGS. 2 and 3 (relating to applications of medicinal products, such as ointments, solutions for vaginal irrigations, creams, etc.), a spout (in the case of the distribution of glues) or a sponge (in the case of the distribution of shoe-creams).

When a cannula 20 is used as distributing element, it is equipped, in correspondence with its lower end, with a non-return stopper-valve, which allows its hermetic sealing until the first moment of use; the stopper valve is, in fact, automatically opened, with its first use, due to the interference between the stopper-valve and sealing devices situated in correspondence with the mouthpiece 14.

A truncated-conical annular wall 18, having a lesser thickness with respect to both the wall of the collar 15 and the wall of the mouthpiece 14, and preferably shaped so as to be convergent towards the longitudinal axis of symmetry 19 of the phial 10, is connected to the collar 15 of the phial 10.

The distributing cannula 20 can be inserted on the phial 10, at the mouthpiece 14, or, alternatively, it can be extracted from inside the body 11 (as shown in FIGS. 2 and 3); if the cannula 20 is contained inside the body 11 of the phial 10, in order to obtain access, it may be necessary to remove a cap 17 (as shown in FIG. 2), having a circumferential edge 21 with a pre-established fracture.

In practice, the use of the distributing phial 10, according to the invention, is achieved by inserting the cannula 20 or extracting it from the body 11 and orientating it in the desired directions, as illustrated in detail in the portion marked by the full line in FIG. 3; the inclination of the cannula 20 is particularly advantageous when particularly delicate and sensitive areas of the human body must be reached for application, or areas which are difficult to reach with the distributing element positioned vertically (portion marked by the dashed line of FIG. 3).

The mouthpiece 14 and cannula 20 have a stable inclined position in the various desired directions, thanks to the consistency and configuration of the truncated-conical wall 18, whose height and thickness parameters are appropriately designed, with respect to the analogous parameters of the collar 15 and mouthpiece 14, so as to obtain the right compromise between the deformability of the material and its consistency, in order to obtain stable positions and avoid frequent and rapid breakage of the phial 10 during the application phase.

In this respect, it is firstly necessary for the internal diameter of the mouthpiece 14, indicated with D in FIG. 4, to be in any case greater than the external diameter D1 of the collar 15.

In this way, as is shown in detail in FIGS. 4 and 5, the truncated-conical wall 18 is partially deformed during the inclination of the distributing element, due to the difference in thickness between the above wall 18 and the walls of the mouthpiece 14 and collar 15, and allows a stable orientation of the mouthpiece itself 14.

In particular, in correspondence with the direction and inclination orientation of the distributing element, the truncated-conical wall 18 allows the inclination of the distributor, as the conformation of this wall enables it to at least partially fold downwards onto the wall of the collar 15, whereas the opposite wall with respect to the inclination direction, indicated with 18A in FIG. 5, is deformed and takes on a substantially vertical position.

At the end of the application, it is possible to bring the mouthpiece 14 back into rest position (the upright position of FIG. 4), by overcoming an initial resistance and subsequently making it spring spontaneously back into the previous aligned rest position.

In preferred but non-limiting embodiments of the invention, the whole mouthpiece 14 can be completely folded back onto the collar 15, as illustrated in detail in FIG. 6; this positioning is obtained by causing the complete deformation of the truncated-conical wall 18, which subsides in correspondence with both of the portions 18A and 18B.

This possible folding back of the distributing element can be particularly useful during applications of the medical type, such as vaginal irrigations or anti-hemorrhoidal treatment, as the application is much more controllable and the pressure exerted by the distributing element on the sensitive areas to be treated is greatly reduced, in particular when the product is to be used on the user himself.

The characteristics of the phial for distributing products, object of the present invention, are clearly outlined in the description provided, as are also the advantages.

In particular, they consist of:

- the possibility of orienting and inclining the distributing element as desired to reach the most difficult areas to be treated and/or the most sensitive and delicate areas of the human body;
- the possibility of completely folding back the mouthpiece onto the collar of the phial, thus favouring medical application and avoiding particularly painful pathologies, in the case of specific treatment, such as vaginal irrigations or anti-hemorrhoidal treatment;
- ideal preservation of hygienic conditions;
- complete airtightness of the phial;
- reduced overall production costs, with respect to distributing phials of the traditional type.

Finally, numerous variations can obviously be applied to the distributing phial in question, without excluding any of the novelty principles which characterize the inventive idea illustrated, and it is also evident that, in the embodiment of the invention, the materials, forms and dimensions of the details illustrated can vary according to the demands and can be substituted with other technically equivalent alternatives.

What is claimed is:

1. A phial (10) for distributing products, with an improved applicability, of the type comprising a container body (11) of the product to be distributed, which is connected, by means of a first collar portion (15) and at least one mouthpiece (14) to a covering and protective element (17) of a distributing device, wherein between said first collar portion (15) and said mouthpiece (14 there is a second truncated-conical annular portion (16), having a lesser thickness with respect to both the thickness of said first collar portion (15) and also with respect to the thickness of said mouthpiece (14) between said distributing device and said mouthpiece (14) at least one capsule is interposed, suitable for guaranteeing a hermetic seal, having at least one portion with a pre-established fracture to allow the use of said distributing device.

2. The phial (10) according to claim 1 characterized in that said second truncated-conical annular portion (18) has at least one wall (18A, 18B) shaped so as to be convergent towards a longitudinal axis of symmetry (19) of said phial (10).

3. The phial (10) according to claim 1 characterized in that between said distributing device and said mouthpiece (14), at least one reducing element (16) is interposed, which frontally rests on said mouthpiece (14) and forms a hermetic seal between the distributing device and reducing element (16) and between the reducing element (16) and the mouthpiece (14).

4. The phial (10) according to claim 1, characterized in that said distributing device consists of at least one cannula (20) for the application of medicinal products, such as ointments, solutions for vaginal irrigations, creams or other products, or a spout, for the distribution of glues or similar products, or a sponge for the distribution of shoe-creams.

5. The phial (10) according to claim 4, characterized in that said cannula (20) can be inserted on said phial 10 in correspondence with said mouthpiece (14) or can be extracted from inside said container body (11).

6. The phial (10) according to claim 1, characterized in that said distributing device can be inclined and oriented in a variety of desired directions, reaching a series of stable inclined positions.

7. The phial (10) according to claim 1, characterized in that said mouthpiece (14) has an internal diameter (D) which is greater than the external diameter (D1) of said collar (15).

8. The phial (10) according to claim 2, characterized in that said mouthpiece (14) can be entirely folded back onto said collar (15), thanks to the complete deformation of said second truncated-conical annular portion (18), in correspondence with said walls (18A, 18B).

* * * * *